US005482783A

United States Patent [19]

Lyons et al.

[11] Patent Number: 5,482,783

[45] Date of Patent: Jan. 9, 1996

[54] VANE RAIL STOCK FOR AIR TURNING ASSEMBLY

[75] Inventors: John E. Lyons, Levitown; Joseph Magrane, Farmingdale, both of N.Y.

[73] Assignee: Duro Dyne Corporation, Farmingdale, N.Y.

[21] Appl. No.: 692,990

[22] Filed: Apr. 29, 1991

[51] Int. Cl.[6] ..... F15D 1/04

[52] U.S. Cl. ..... 428/582; 428/596; 138/39

[58] Field of Search ..... 428/573, 582, 428/603, 596, 598; 138/39; 98/121.1; 415/209.3, 209.4; 29/513; 454/254

[56] References Cited

U.S. PATENT DOCUMENTS

| | | | |
|---|---|---|---|
| 2,115,367 | 4/1938 | Levy et al. | 29/513 |
| 2,826,221 | 3/1958 | Speiser | 98/121.1 |
| 2,861,597 | 11/1958 | Gracer | 138/39 |
| 2,959,195 | 11/1960 | Gracer | 138/39 |
| 2,972,358 | 2/1961 | Hinden | 98/121.1 |
| 3,190,250 | 6/1965 | Hinden | 29/513 |
| 3,195,228 | 7/1965 | Beacham | 29/513 |
| 3,405,737 | 10/1968 | Harper | 138/39 |
| 3,602,262 | 8/1971 | Hinden | 138/39 |
| 4,995,426 | 2/1991 | Hinden | 138/39 |

OTHER PUBLICATIONS

"Duro Vane Rail", Sheet Metal Worker, Oct. 1953, pp. 28, 29.

*Primary Examiner*—John Zimmerman

*Attorney, Agent, or Firm*—Mark T. Basseches; Paula T. Basseches

[57] ABSTRACT

An apparatus and method of forming air turning assemblies is disclosed along with a novel vane supporting rail structure for use therewith. The apparatus holds a pair of rails in spaced parallel relation at a clinching station at which the edges of a vane may be engaged in opposed slotted protuberances in the rails. The spacing of the rails may be increased at the station against a yieldable biasing force, the station including a deforming mechanism for deflecting the vane edges to lock the vanes to the rails. The rails include cam surfaces leading to the vane receiving slots and blocking walls at the trailing ends of the slots to facilitate introducing the vane edges into the slots.

2 Claims, 6 Drawing Sheets

13
19
15
17
27
23
17
12
14
28
11
10
36

VANE RAIL STOCK FOR AIR TURNING ASSEMBLY

BACKGROUND OF THE INVENTION

1. Field of the Invention

The present invention is in the field of air turning devices for mounting within ducting of air conditioning systems to facilitate the flow of air around corners in the system so as to minimize turbulence and frictional losses.

More specifically, the present invention is directed to an improved method of manufacturing air turning assemblies, to apparatus for fabricating such assemblies, and to stock material for use therewith.

2. The Prior Art

It is conventional in air conduits or ducting such as are employed in air conditioning systems to provide air turning assemblies at positions where sections of ducting meet in angular relation. Such air turning assemblies generally comprise upper and lower rails, known as vane rails, between which are mounted a series of arcuate vanes. The turning assemblies guide the air from one duct arm to the next, minimizing turbulence.

Examples of such air guide devices and stock materials from which the same may be made are found in U.S. Pat. Nos. 2,861,597 of Nov. 25, 1958; 2,972,358 of Feb. 21, 1961; 2,959,195 of Nov. 8, 1960; 3,190,250 of Jun. 22, 1965; 3,494,379 of Feb. 10, 1970; 3,602,262 of Aug. 31, 1971 and 4,995,426 of Feb. 26, 1991, as well as certain references cited therein.

Heretofore the manufacture of such devices has been a labor-intensive process.

More specifically, to fabricate an air turning assembly it is conventional practice to provide a pair of vane rails in accordance, for instance, with U.S. Pat. No. 2,861,597. The rails comprise flat sheet metal blanks having pairs of raised protuberances regularly spaced along the length thereof, the protuberances being slotted to receive the edge portions of vanes.

The manufacturing procedure involves placing an edge of a vane in the paired protuberances and securing the vane to the rail by distorting the edge portion of the vane projecting through the slots of the protuberances.

After the first vane is thus affixed the worker must repeat the process serially, mounting vanes in each of the paired protuberances of the first rail. Thereafter the rail carrying the first edges of the series of vanes is placed downmost and the second rail applied over the free edges of the vanes one by one, inserting the free edges into the protuberances and distorting the projecting edge portions as set forth above to lock the free edges of the vanes to the second rail.

The operation of manually mounting the vanes in the rails, inserting the partially fixed vanes, serially applying the free edges of the vanes to the second rail, etc. is time-consuming and frequently, in handling, one or more of the vanes will become dislodged from the first rail, requiring reinsertion and re-affixation.

SUMMARY OF THE INVENTION

The present invention may be summarized as directed to an apparatus and method for fabricating air turning assemblies, and to a stock material which facilitates the assembly.

In accordance with the invention there is provided a stock vane rail material characterized in that the vane holding protuberances include angularly related slots as conventional, the slots being defined by a lead and a trailing wall, the trailing wall being deflected further from the plane of the rail than the lead wall. An inclined portion extends from the plane of the rail to the lead wall and defines a cam surface.

In accordance with the method of the invention, a pair of rails as described are disposed in parallel spaced relation in accordance with the height of the vanes.

Vanes are progressively inserted into the protuberances of the respective upper and lower spaced rails by inserting an edge portion of the vane in the slots of the paired protuberances of one of the rails and advancing the other edge of the vane up the incline leading to the slots of the second vane, insertion being facilitated by the higher trailing walls of the protuberances functioning as a stop against which an end face of the vane will abut, positively to locate the edge of the vane with respect to the slots of the second rail.

With the vane thus positioned, the edge portions of the vane projecting through the four slots are simultaneously distorted, positively to lock the vane between the spaced parallel rails.

The invention is further directed to an apparatus for feeding vane rails to an attachment station while maintaining the same in parallel spaced relation, the apparatus enabling the facile positioning of vanes between the rails at said station and the anchoring or simultaneous coupling of both ends of the vanes to the said rails at such station.

It is accordingly an object of the invention to provide a method and apparatus for facilitating the formation of air turning assemblies.

More specifically, it is an object of the invention to provide apparatus which enables air turning vanes to be serially introduced into operative position between a spaced pair of vane rails at a staking station, positioning of the vane being facilitated by a unique configuration of the protuberances formed on the rails which enable a snap fitted introduction of the vanes, the insertion being facilitated by means at the staking station, enabling limited spreading of the rails at the station to provide clearance for introduction of the vanes.

A still further object of the invention resides in the provision of an improved stock vane rail material enabling upper and lower supported rails to be incrementally advanced to the vane mounting and staking station.

Still a further object of the invention is the provision of a method of manufacturing air turning vane assemblies which obviates the necessity heretofore universally employed of affixing a first end of a series of vanes to a first rail and thereafter mounting the free ends of the vanes into a second rail and affixing the same in position.

Still other and further objects will appear herein or be hereinafter pointed out in connection with the accompanying drawings.

DETAILED DESCRIPTION OF THE DRAWINGS

Figure 1:
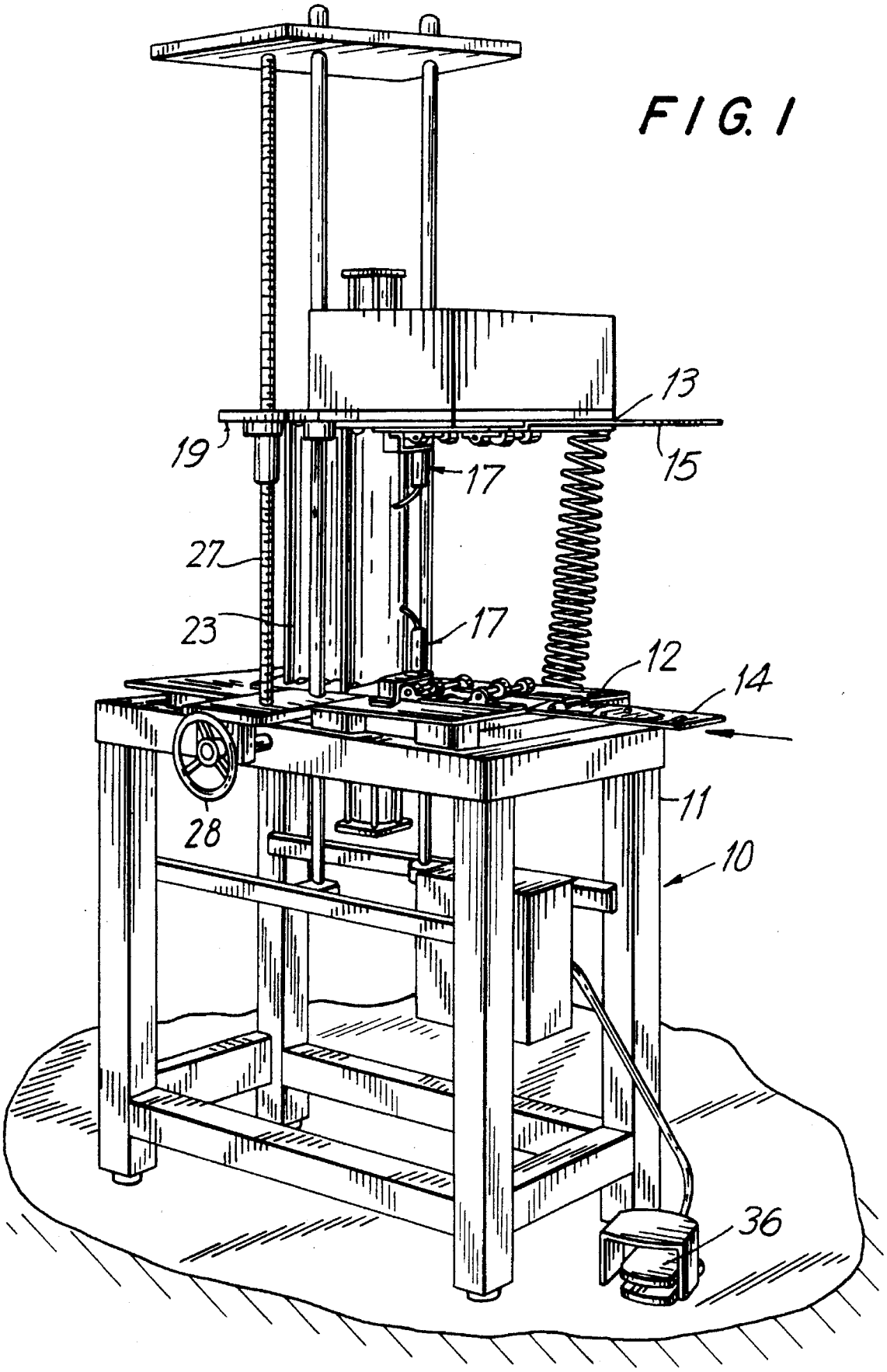
FIG. 1 is a perspective view of an apparatus for forming air turning vanes.
Figure 10:
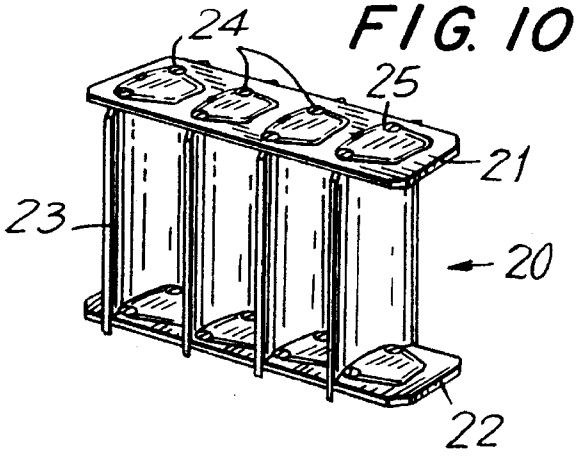
FIG. 10 is a perspective view of a completed vane rail assembly.
Figure 12:
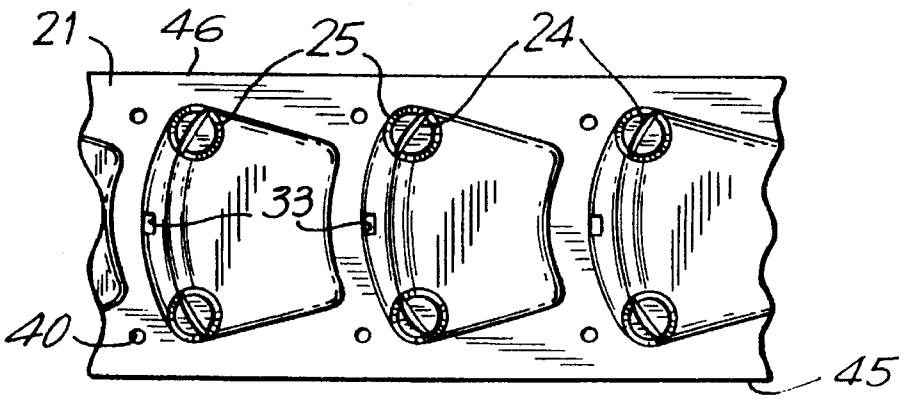
FIG. 12 is a fragmentary top plan view of a length of vane rail stock material in accordance with the invention.

Referring now to the drawings, there is shown in FIG. 1 apparatus for fabricating air turning assemblies such as are shown in FIG. 10 hereof.

In order better to understand the operation of the apparatus it is helpful to comprehend the structure of an air turning assembly such as shown in said FIG. 10.

Referring to FIG. 10, the air turning assembly 20 includes upper and lower vane rail members 21,22, respectively, the rails being coupled to the endmost portions of air turning vanes 23 (four being illustrated).

The vanes 23 are supported between the parallel rails 21,22 as a result of the edge portions of the vanes being disposed within slots 24 formed in protuberances 25 deflected from the plane of the rails, the protuberances of the respective rails facing each other.

As is conventional, the edge portions of the vanes project through the slots 24 and are retained therein by distortion or deformation, such as by being struck with a chisel, bent or likewise prevented from retractile movement through the slots.

In conventional practice the edges of each of the vanes would be mounted within respective paired protuberances of one or the other of the rails 21,22 and locked to the said rail by distortion in the manner set forth. Thereafter the loosely mounted vanes would be emplaced sequentially in appropriately positioned slots in the opposite rail. Finally, the projecting edge portions in the protuberances of the second said rail would be deformed as by a cutting chisel to lock the vanes in position.

The fabrication method described is tedious and frequently blades are dislodged from connection with the first rail in the course of attempting to located the free edges of the vanes relative to the slots of the second rail.

With the foregoing explanation in mind, it is the function of the method, apparatus and unique rail structure of the instant invention to facilitate positioning of a vane simultaneously between a spaced parallel pair of rails and thereafter to lock the edges of the vane to both rails at once. The vanes are mounted seriatim until a completed air turning assembly is fabricated.

Turning now to FIG. 1, there is shown an apparatus 10 for manufacturing air turning assemblies, the apparatus including a support frame 11 having a lower and an upper track 12,13, wherein vane supporting rails 14,15 are slidably mounted for movement in parallel horizontal planes.

Broadly stated, the apparatus includes (FIG. 2) a feed assembly 16, a stop or locator assembly 17, and a vane loading and clinching station 18. Each of the elements 16, 17, 18, which are in a measure shown schematically, has an upper counterpart being a mirror image of the illustrated lower stations. The counterpart stations project beneath the upper platform 19.

Since the counterpart components to the elements 16, 17, 18 are identical and operate simultaneously on the upper rails as components 16, 17 and 18 operate on the lower rails, a description of the lower said components will suffice.

Moreover, since the means for effecting simultaneous movement of the vane rails 14, 15 in tracks 12 and 13 to the staking station 18 are essentially conventional and may be carried out by any of a variety of mechanisms, including pneumatic drives, chain drives, etc., the description thereof will be kept to a minimum consonant with an understanding of the essential features of the invention.

As will be readily understood by those skilled in the art, the air turning assemblies 20 will employ vanes whose length is coordinated with the overall height of the ducts in which they are to be mounted.

In order to accommodate vanes 23 of a variety of heights, the upper platform assembly 19 is variably spacable from the base portion 26 carrying track 12 by a vertically directed threaded member 27 driven through bevel gears (not shown) by adjustment hand wheel 28. Rotation of the wheel 28 will rotate member 27 to raise or lower the upper platform assembly 19, with resultant adjustment of the spacing of the upper and lower guide tracks 12,13. Parallelism of the tracks throughout their adjusted positions is maintained by vertically directed guide posts 29,30.

Figure 3:
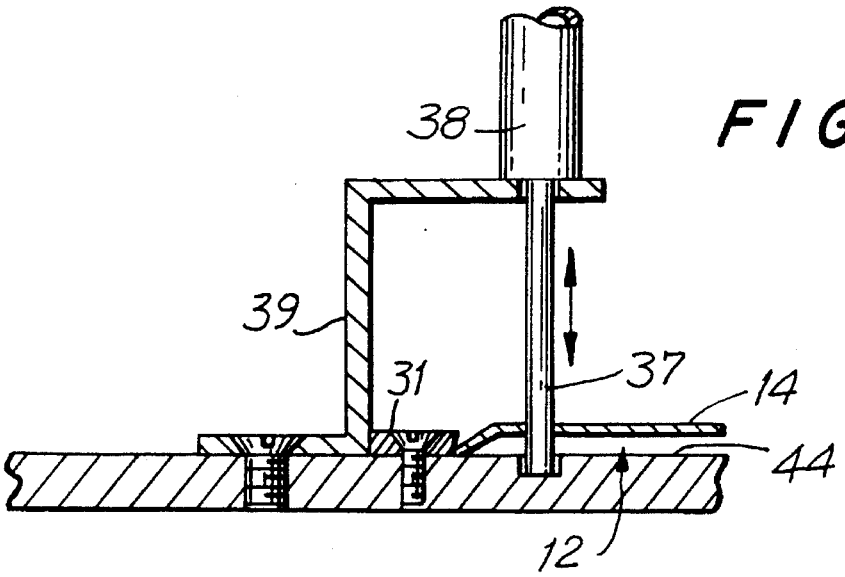
FIG. 3 is a fragmentary magnified vertical section taken on the line 3—3 of FIG. 2.
Figure 4:
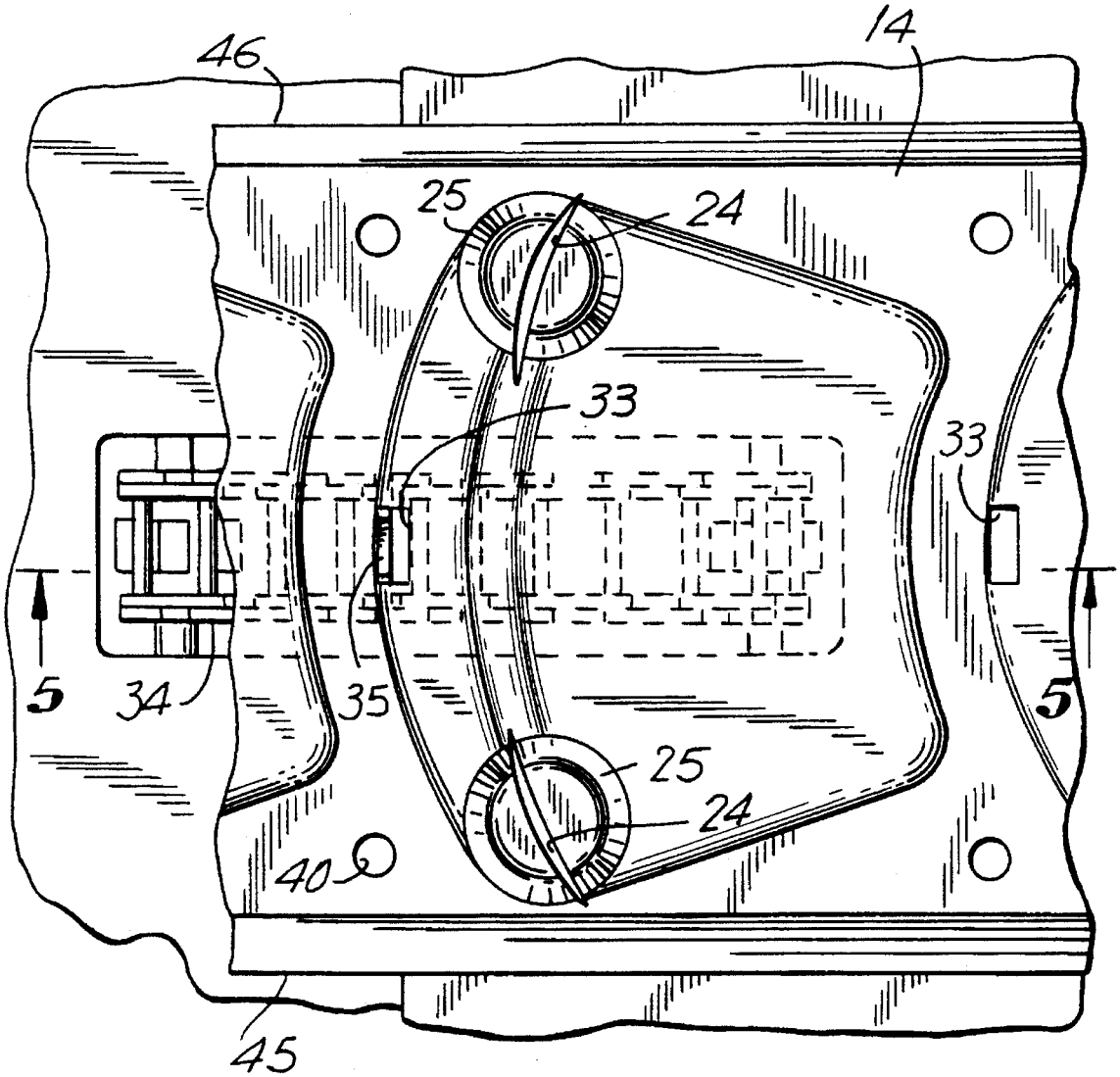
FIG. 4 is a fragmentary top plan view partly in phantom illustrating the feed mechanism for advancing the vane rails.

The tracks 12,13 slidably support the upper and lower vane rails 15 and 14 for horizontal movement by parallel chamfered guide strips 31 (one such strip being shown in FIG. 3), which overlie the longitudinal marginal edges of the vane rails.

Figure 2:
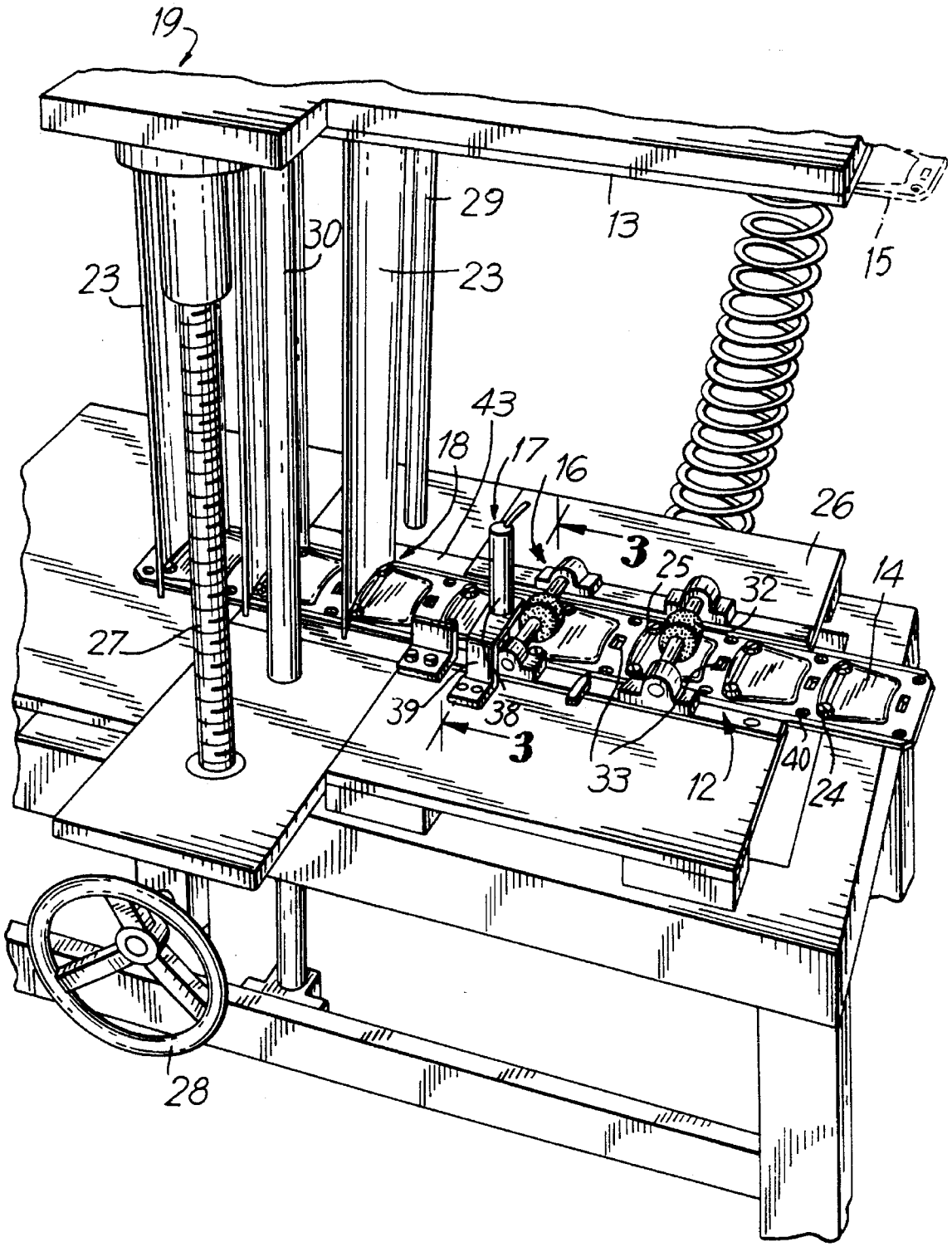
FIG. 2 is an enlarged perspective view of the feed, locating and staking stations of the apparatus.

Referring to FIG. 2, the rails are maintained within the tracks 13,14 as by hold-down rollers 32 a comparable roller being formed adjacent the upper track 13.

Figure 5:
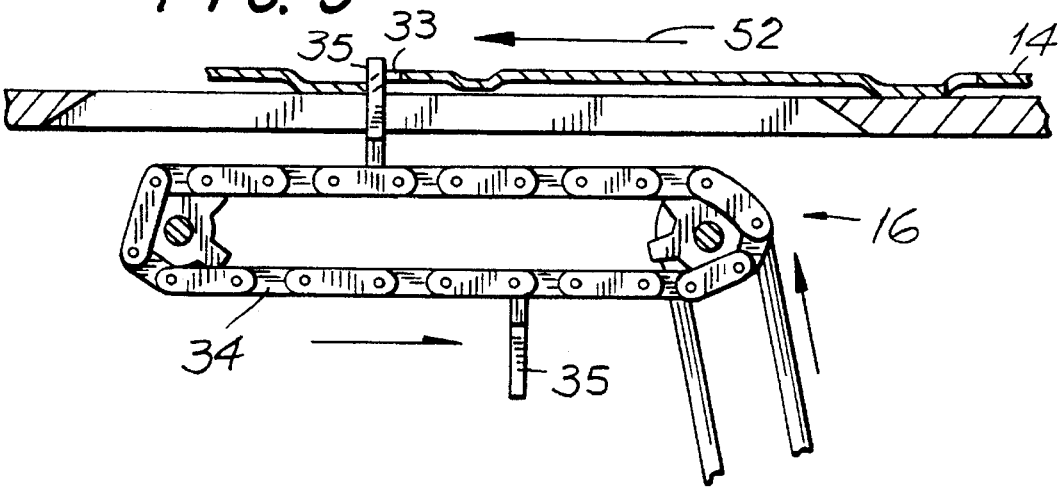
FIG. 5 is a vertical sectional view taken on the line 5—5 of FIG. 4, partially schematic in nature.
Figure 6:
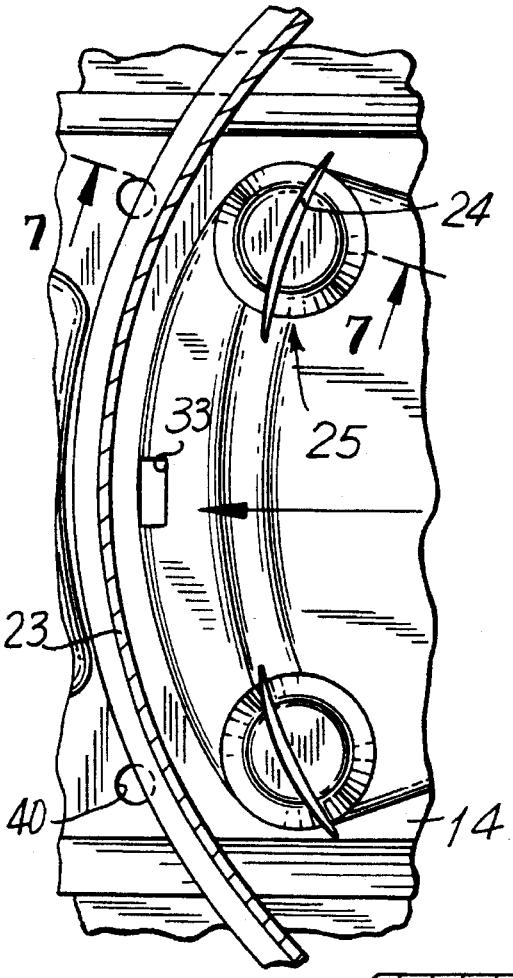
FIG. 6 is a horizontal sectional view through a vane, depicting the relative positions of a vane and the lower rail prior to insertion of the vane with the parts disposed at the staking station.

Forward feed of the rails 13,14 is effected by drive mechanism 16 which cooperates with central drive sprockets 33 formed at regularly longitudinally spaced positions along the vane rails. A schematic showing of the drive mechanism is depicted in FIG. 5 wherein chain 34 carrying drive teeth 35 is advanced by a predetermined increment upon each activation of the actuator pedal 36 (FIG. 1).

As will be appreciated, when the chain is advanced by a predetermined increment the drive tooth engaged in a sprocket will advance the rail a predetermined distance and the next succeeding tooth will enter into the next sprocket of the rail.

Likewise energized by the actuator pedal 36 is a stop assembly 17 (FIG. 3) which includes a downwardly reciprocating pin 37 driven by air cylinder 38 mounted on bracket 39. The cylinder 38 is timed to be actuated following advance of the upper and lower rails by the feed assembly 16 and functions to project the pin 37 through a side sprocket 40 formed in the vane rail, so as positively to establish the position of the upper and lower rails during a vane loading and a clinching stroke.

Figure 7:
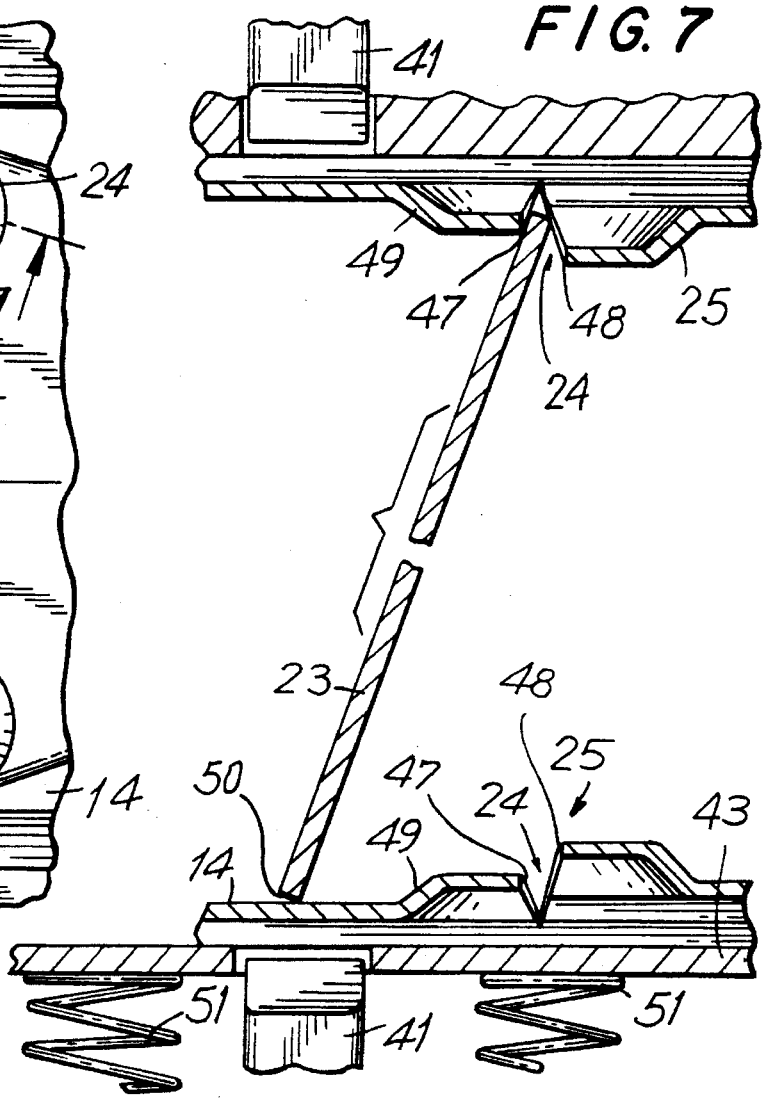
FIG. 7 is a vertical section taken on the line 7—7 of FIG. 6 showing the upper edge of a vane positioned within the upper vane rail and the lower edge of the vane immediately prior to inserted position into the lower rail.
Figure 9:
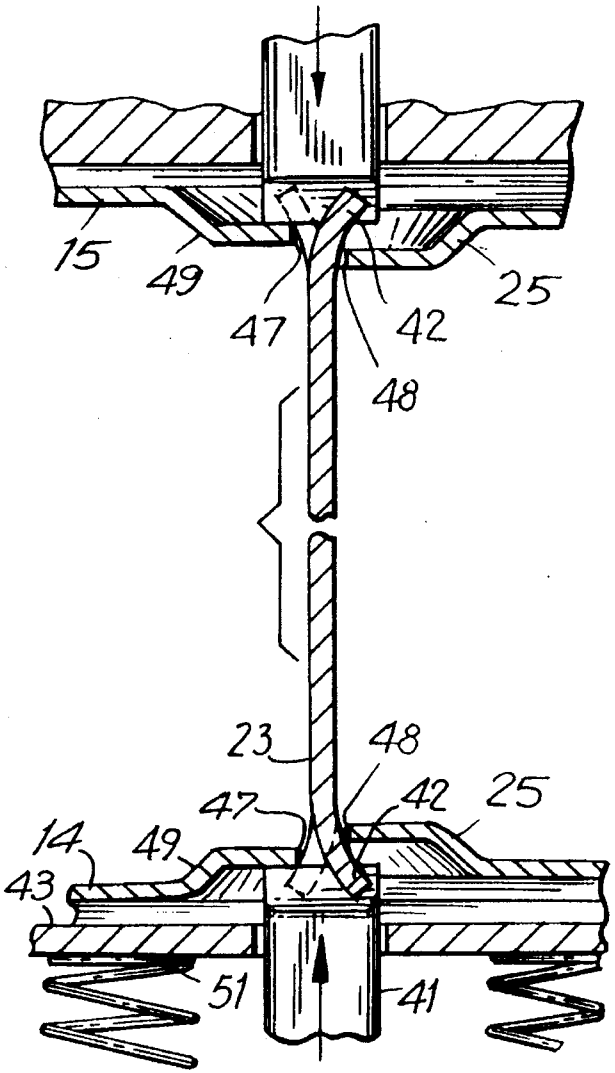
FIG. 9 is a view similar to FIG. 8 during the staking or fastening operation.
Figure 8:
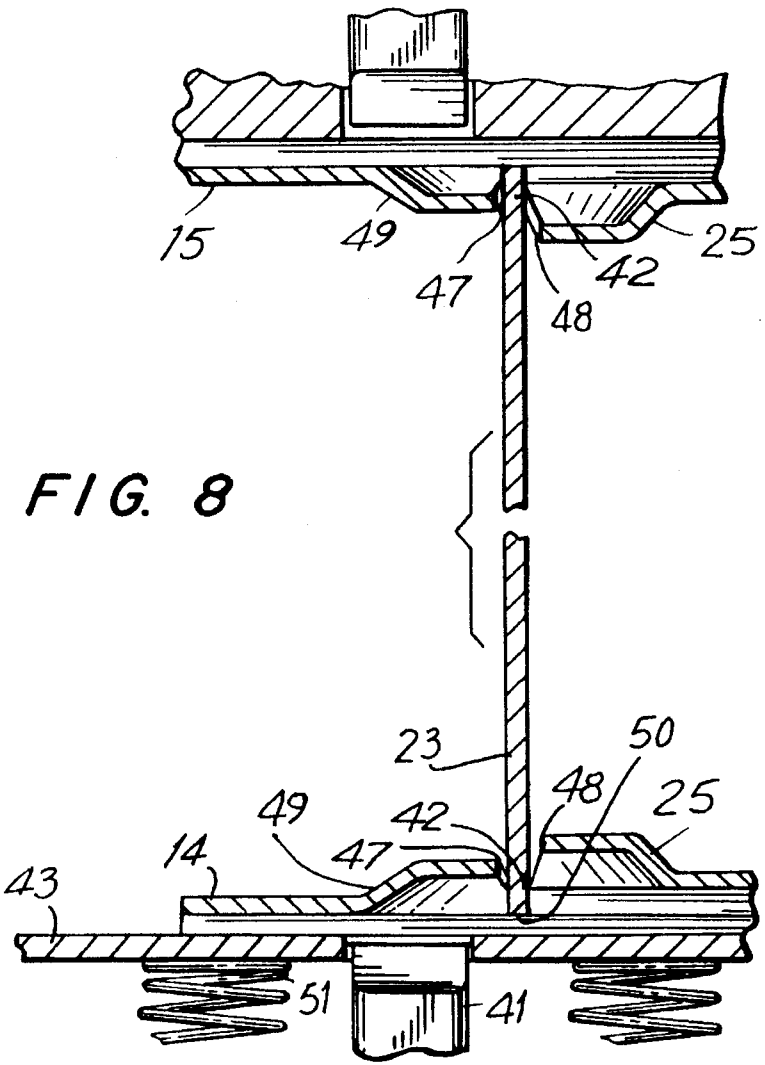
FIG. 8 is a view similar to FIG. 7 showing a vane in its final position between opposed vane rails.

The clinching operation is effected at clinching station 18. The essential components of the clinching station are schematically illustrated in FIGS. 7 to 9.

At such station there are located four air driven chisel members 41 which register with protuberances 25 of the upper and lower rails 15 and 14 as the paired protuberances of the rails are successively aligned with the clinching station by the feed assembly 16.

The four chisels 41, upon activation of the actuator pedal 36, are driven toward each other simultaneously to cut the end portions 42 of the vanes 23 which project through slots 24 of protuberances 25 so as to lock the vane edges to the rails. The chisels are energized preferably by linear acting air cylinders (not shown).

The clinching station 18 includes a support base 43 which is vertically movably mounted, being normally biased to the same level as the upper surface 44 supporting lower vane rail 14. No counterpart to the support base 43 is found on the upper platform assembly 19.

In order to appreciate the significant advance of the instant invention, namely the manner in which vane members may be rapidly loaded into position within the slots 24 of protuberances 25 of the opposed vane rails, there will now be described in detail the unique structure of the vane rails, which is best illustrated in FIGS. 6, 7, 8 and 12.

The rails include parallel side margins 45,46. Equally spaced to opposite sides of the center line of the rails are formed pairs of protuberances 25, the protuberances including transversely directed slots 24. The slots of each pair are angularly inclined to define an obtuse angle whose apex is generally coincident with the longitudinal center line of the rails. It will thus be appreciated that arcuate vanes 23 will fit within the respective slots 24 of a pair of protuberances. As so far described, the rails are essentially conventional.

In accordance with the present invention the protuberances 25 are uniquely configured to facilitate the introduction of the vane edges thereinto in a manner next described.

More specifically, the slots of the protuberances are defined by a leading wall 47 and a trailing wall 48, the trailing wall 48 being deflected a greater distance from the plane of the rail than the leading wall 47—see FIGS. 7 and 8.

In addition, a ramp or cam surface 49 forming a part of the protuberances sloshes from the plane of the rail essentially to the height of the lead wall 47 of the protuberances. As more completely described hereafter, the configuration of the protuberances is such as greatly to simplify and expedite the introduction of edge portions of the vanes 23 into the slots 24.

The introduction, which is effected at the clinching station 18 is effected by placing the upper edge of a vane into the slots of a pair of protuberances supported in the upper track 13 of the apparatus while the vane is maintained in an angular orientation between the parallel vane rails (see FIG. 7). With the upper edge thus positioned, the lower edge of the vane is slid along the surface of the lower rail in a direction from left to right as viewed in FIG. 7. As the lower edge 50 of the vane progressively approaches the protuberances in the lower rail the lower edge 50 scans ramp portion 49 of said protuberances. The lower rail will be bowed or deflected downwardly by the resultant caming action, a movement which is accommodated by the support platform 43 which is downwardly shiftable against the upward biasing forces of springs 51 disposed beneath the platform 43.

The lower edge 50 will continue to scan the upper surface of protuberances 25 until further scanning movement is blocked by upwardly projecting trailing walls 48 of the protuberances of the lower rail. Wall 48 provides a limit stop whereby the lower edge 50 is maintained in alignment with the slots of the lower vane rail section, whereupon the upward biasing forces of springs 51 will force platform 43 and the lower rail carried thereon upwardly positively to lock the vane in aligned position within the slots of the lower vane rail.

With the vane thus positioned, the chisels 41 are simultaneously driven (by activation of pedal 36) into the hollows of the four protuberances with which they are aligned simultaneously distorting the vane edges at four positions in registry with the protuberances, thus locking the vane between the rails.

OPERATING SEQUENCE

The operation of the device will be readily apparent from the proceeding description.

A rail section is loaded into the upper and lower tracks and manually advanced such that the lead pair of protuberances of each rail is aligned at the clinching station 18.

In such position the upper and lower vanes are locked against longitudinal movement downwardly based by pin 37. Thereupon a first vane is loaded into the protuberances disposed in registry with the clinching station in the manner previously described, i.e. upper edge inserted into slots of upper rail with vane at an angle; lower edge inserted into slots of lower rail by horizontally sliding the lower edge of the vane to a vertical position until the lower edge snaps into the slots of the lower rail. The operator will now depress actuator pedal 36 to drive chisels 41 through an operative clinching cycle.

In timed relation the pins 37 are withdrawn from sprockets 40 and drive mechanism 16 is automatically activated to advance drive tooth 35 in the direction of arrow 52 (FIG. 5), shifting the next pair of protuberances to the clinching station and permitting locking pins 37 to extend through sprocket holes 40 to lock the rails at the said aligned position.

At this juncture a further vane may be inserted into the slots of the rails aligned at the clinching station and the actuator pedal energized to clinch the edges of the inserted vane to the rails.

The sequence is repeated until the air turning assembly has been fitted with the proper number of vanes, following which a new pair of rails are inserted into the apparatus and loaded with vanes as aforesaid.

Figure 11:
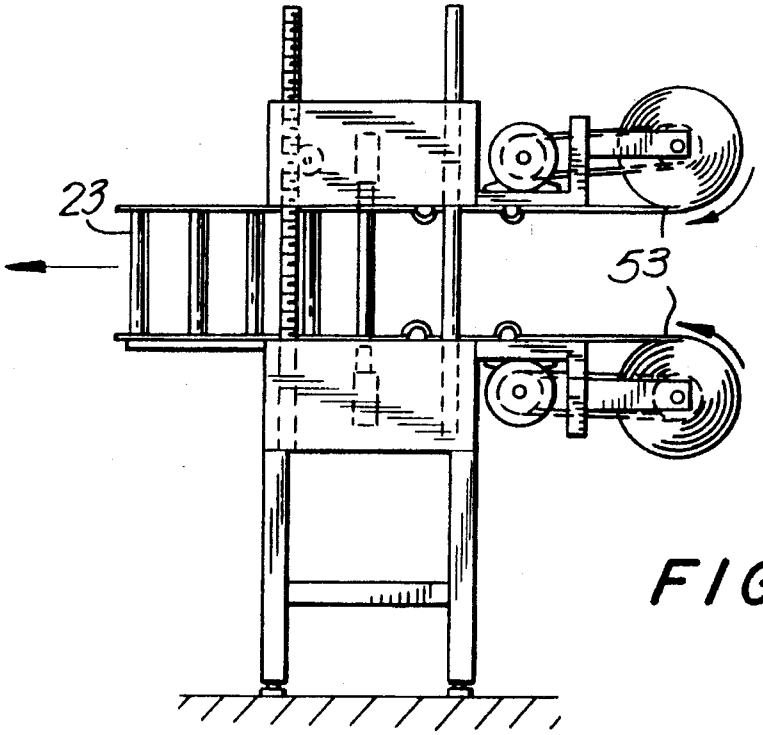
FIG. 11 is a side elevational view of a modified apparatus for fabricating air turning assemblies from a roll of stock vane rail material.

Optionally, as shown in FIG. 11, the rails may be fed from coils 53 of stock material, increments of the stock material being cut after being loaded with vanes in accordance with the longitudinal extent of the air turning assembly.

Also, while the rails have been disclosed to include pairs of spaced protuberances to opposite sides of the center line of the rail, it is equally feasible to employ spaced single protuberances with arcuate slots, the protuberances having the cam and stop features noted.

As will be apparent from the preceding description, there is provided in accordance with the invention an apparatus and method for fabricating air turning assemblies which greatly expedites and facilitates these operations. Likewise described is a novel vane rail stock material which coacts with the apparatus to expedite positioning of a vane in clinching position between the rails. It will be understood that description of certain details of the apparatus have been schematically illustrated for purposes of facilitating an understanding of the functional operation thereof, and accordingly the mechanical expedients depicted should be considered as illustrative and not limitative.

Numerous variations in details of construction of the apparatus, vane rail and method may occur to skilled workers in the art familiarized with the instant disclosure. Accordingly, the invention is to be broadly construed within the scope of the appended claims.

Having thus described the invention and illustrated its use, what is claimed as new and is desired to be secured by Letters Patent is:

1. In a sheet metal vane rail stock material for the reception of air turning vanes of the type which comprises an elongate, generally planar metal strip having a plurality of longitudinally spaced vane edge receiving protuberances deflected from the plane of said strip, the protuberances being located along a common line perpendicular to the longitudinal axis of said strip, the protuberances including a slot or slots formed therein, said slots being angularly oriented relative to the longitudinal center line of said strip, whereby projections of said slots intersect and define an obtuse angle having an apex located substantially at said center line, the improvement which comprises said strip being resilient and said slots of said protuberances being defined by a lead wall and a trailing wall, said trailing wall being spaced further from the plane of said strip than said lead wall, said protuberances including an incline portion sloping away from the plane of said strip toward and terminating generally at said lead wall, whereby an edge portion of an air turning vane advanced along said strip in the direction from said lead wall toward said trailing wall will coact with said incline portion and deflect said strip away from said edge portion until said edge portion is blocked from further movement in said direction by said trailing wall and enters said slot or slots.

2. A vane rail in accordance with claim 1 and including longitudinally spaced sprocket apertures formed along the length thereof, the spacing between said sprocket apertures being coordinated with the longitudinal spacing of said protuberances.

* * * * *